US012497848B2

(12) United States Patent
Bryant et al.

(10) Patent No.: US 12,497,848 B2
(45) Date of Patent: Dec. 16, 2025

(54) IGNITER FOR ACTIVATING A DOWNHOLE COMPONENT AND METHOD OF USING SAME

(71) Applicant: GR Energy Services Management, LP, Sugar Land, TX (US)

(72) Inventors: Cameron Michael Bryant, Sugar Land, TX (US); James William Anthony, Missouri City, TX (US); Vadim Akhmadikin, Sugar Land, TX (US)

(73) Assignee: GR Energy Services Management, LP, Sugar Land, TX (US)

( * ) Notice: Subject to any disclaimer, the term of this patent is extended or adjusted under 35 U.S.C. 154(b) by 0 days.

(21) Appl. No.: 18/566,510

(22) PCT Filed: Jun. 1, 2022

(86) PCT No.: PCT/US2022/031837

§ 371 (c)(1),
(2) Date: Dec. 1, 2023

(87) PCT Pub. No.: WO2022/256450

PCT Pub. Date: Dec. 8, 2022

(65) Prior Publication Data

US 2024/0254846 A1 Aug. 1, 2024

Related U.S. Application Data

(60) Provisional application No. 63/195,521, filed on Jun. 1, 2021.

(51) Int. Cl.
*E21B 23/04* (2006.01)
*E21B 23/06* (2006.01)

(52) U.S. Cl.
CPC ..... *E21B 23/0414* (2020.05); *E21B 23/06* (2013.01)

(58) Field of Classification Search
CPC ..... E21B 23/0414; E21B 23/06
See application file for complete search history.

(56) References Cited

U.S. PATENT DOCUMENTS 2,409,811 A 10/1946 Taylor et al.
2,705,159 A 3/1955 Pfau
(Continued)

OTHER PUBLICATIONS

GR Energy Services, ZipSet Setting Tool, GR-PUB031-20180103, dated Jan. 3, 2018, p. 1.
(Continued)

*Primary Examiner* — Taras P Bemko
(74) *Attorney, Agent, or Firm* — JL Salazar

(57) ABSTRACT

An igniter for activating a downhole component of a downhole tool includes an igniter housing, a switch assembly, and a propellant. The igniter is positionable in the downhole tool, and includes an igniter portion and a nose portion. The igniter portion has a switch chamber therein. The nose portion has a propellant opening therethrough. The switch assembly is positioned in the switch chamber, and includes a switch movable between an untriggered and a triggered position. The propellant is supported by the nose portion. The propellant is connected to the switch and is ignitable thereby when the switch is moved to the triggered position whereby the propellant releases a pressurized fluid through the propellant opening to activate the downhole component.

29 Claims, 15 Drawing Sheets

(56) References Cited

U.S. PATENT DOCUMENTS

| | | | |
|---|---|---|---|
| 3,024,843 | A | 3/1962 | Vaughan |
| 3,062,292 | A | 11/1962 | Lowrey et al. |
| 3,211,222 | A | 10/1965 | Myers |
| 3,713,393 | A | 1/1973 | O'Connor et al. |
| 3,966,236 | A | 6/1976 | Vann |
| 4,776,393 | A | 10/1988 | Forehand et al. |
| 5,242,201 | A | 9/1993 | Beeman |
| 5,984,006 | A | 11/1999 | Read et al. |
| 6,095,583 | A | 8/2000 | Beeman et al. |
| 6,431,269 | B1 | 8/2002 | Post et al. |
| 6,450,541 | B1 | 9/2002 | Bakke |
| 6,520,089 | B1 | 2/2003 | Avanci et al. |
| 7,198,101 | B2 | 4/2007 | McGarian et al. |
| 7,409,987 | B2 | 8/2008 | Fjelde |
| 7,810,569 | B2 | 10/2010 | Hill et al. |
| 8,267,012 | B2 | 9/2012 | Peeters et al. |
| 8,960,093 | B2 | 2/2015 | Preiss et al. |
| 9,581,422 | B2 | 2/2017 | Preiss et al. |
| 9,605,937 | B2 | 3/2017 | Eitschberger et al. |
| 9,810,035 | B1 * | 11/2017 | Carr ..... E21B 23/065 |
| 9,822,596 | B2 | 11/2017 | Clemens et al. |
| 9,822,618 | B2 | 11/2017 | Eitschberger |
| 9,915,513 | B1 | 3/2018 | Zemla et al. |
| 10,036,236 | B1 | 7/2018 | Sullivan et al. |
| 10,309,199 | B2 | 6/2019 | Eitschberger |
| 10,365,079 | B2 | 7/2019 | Harrington et al. |
| 10,507,433 | B2 | 12/2019 | Eitschberger et al. |
| 10,626,689 | B2 * | 4/2020 | Moyes ..... E21B 34/06 |
| 10,689,931 | B2 | 6/2020 | Mickey et al. |
| 10,760,384 | B2 | 9/2020 | Schmidt et al. |
| 10,794,122 | B2 | 10/2020 | Kitchen et al. |
| 10,844,678 | B2 | 11/2020 | Mickey et al. |
| 10,858,919 | B2 | 12/2020 | Anthony et al. |
| 11,073,005 | B2 | 7/2021 | Schmidt et al. |
| 11,078,763 | B2 | 8/2021 | Anthony et al. |
| 12,123,273 | B1 | 10/2024 | Roach et al. |
| 2004/0134667 | A1 | 7/2004 | Brewer et al. |
| 2006/0048940 | A1 | 3/2006 | Hromas et al. |
| 2006/0070739 | A1 | 4/2006 | Brooks et al. |
| 2013/0008669 | A1 | 1/2013 | Deere et al. |
| 2014/0033939 | A1 | 2/2014 | Priess et al. |
| 2015/0247368 | A1 | 9/2015 | Clemens et al. |
| 2015/0345922 | A1 | 12/2015 | Lanclos et al. |
| 2016/0047199 | A1 | 2/2016 | Hardesty et al. |
| 2016/0061572 | A1 | 3/2016 | Eitschberger et al. |
| 2016/0115753 | A1 | 4/2016 | Frazier et al. |
| 2016/0356132 | A1 | 12/2016 | Burmeister et al. |
| 2017/0030693 | A1 | 2/2017 | Preiss et al. |
| 2017/0074078 | A1 | 3/2017 | Eitschberger |
| 2018/0038208 | A1 | 2/2018 | Eitschberger |
| 2018/0080298 | A1 | 3/2018 | Covalt et al. |
| 2018/0224260 | A1 | 8/2018 | Zemla et al. |
| 2018/0258724 | A1 | 9/2018 | Massey et al. |
| 2018/0299239 | A1 | 10/2018 | Eitschberger et al. |
| 2019/0086189 | A1 | 3/2019 | Eitschberger et al. |
| 2019/0106969 | A1 * | 4/2019 | Sullivan ..... E21B 43/1185 |
| 2019/0127290 | A1 | 5/2019 | Löhken et al. |
| 2019/0178045 | A1 | 6/2019 | Frazier et al. |
| 2019/0234189 | A1 | 8/2019 | Preiss |
| 2019/0242209 | A1 | 8/2019 | Anthony et al. |
| 2019/0242222 | A1 | 8/2019 | Eitschberger |
| 2019/0277103 | A1 * | 9/2019 | Wells ..... E21B 47/13 |
| 2019/0330947 | A1 | 10/2019 | Mulhern et al. |
| 2019/0376775 | A1 | 12/2019 | Preiss et al. |
| 2020/0024935 | A1 | 1/2020 | Eitschberger et al. |
| 2020/0032601 | A1 | 1/2020 | Nguyen et al. |
| 2020/0048996 | A1 | 2/2020 | Anthony et al. |
| 2020/0063537 | A1 * | 2/2020 | Langford ..... F42D 1/05 |
| 2020/0072029 | A1 | 3/2020 | Anthony et al. |
| 2020/0182025 | A1 | 6/2020 | Brady |
| 2020/0256166 | A1 | 8/2020 | Knight et al. |
| 2020/0277837 | A1 | 9/2020 | Hern et al. |
| 2020/0362652 | A1 * | 11/2020 | Eitschberger ..... E21B 23/04 |
| 2021/0040805 | A1 | 2/2021 | Kehoe et al. |
| 2021/0047903 | A1 | 2/2021 | Albert |
| 2021/0123311 | A1 | 4/2021 | Rosenthal |
| 2022/0145732 | A1 | 5/2022 | Anthony et al. |
| 2024/0035347 | A1 | 2/2024 | Zakharia et al. |
| 2024/0254846 | A1 | 8/2024 | Bryant et al. |
| 2024/0254847 | A1 | 8/2024 | Bryant et al. |
| 2024/0254848 | A1 | 8/2024 | Bryant et al. |
| 2024/0254849 | A1 | 8/2024 | Bryant et al. |

OTHER PUBLICATIONS

PCT International Search Report and Written Opinion dated Aug. 24, 2022, pp. 1-13.

Saudi Arabian office action dated Nov. 19, 2024 with translation, pp. 1-11.

* cited by examiner

IGNITER FOR ACTIVATING A DOWNHOLE COMPONENT AND METHOD OF USING SAME

CROSS-REFERENCE TO RELATED APPLICATIONS

This application claims the benefit of U.S. Provisional Application No. 63/195,521 filed on Jun. 1, 2021, the entire contents of which are hereby incorporated by reference herein to the extent not inconsistent with the present disclosure. Applicant also filed U.S. Provisional Application Nos. 63/195,540; 63/195,551; and 63/222,578 on the same date as the present application, the entire contents of each of which are hereby incorporated by reference herein to the extent not inconsistent with the present disclosure.

BACKGROUND

The present disclosure relates generally to oilfield technology. More specifically, the present disclosure relates to downhole tools and downhole activators.

Wellsite operations are performed to locate and access subsurface targets, such as valuable hydrocarbons. Drilling equipment is positioned at the surface and downhole drilling tools are advanced into the subsurface formation to form wellbores. Once drilled, casing may be inserted into the wellbore and cemented into place to complete the well. Once the well is completed, production tubing may be deployed through the casing and into the wellbore to produce fluid to the surface for capture.

During the wellsite operations, various downhole tools, may be deployed into the earth to perform various procedures, such as measurement, perforation, injection, plugging, etc. Examples of downhole tools are provided in US Patent/Application Nos. 10200024935; U.S. Pat. No. 10,507,433; 20200277837; 20170376775; 20170330947; 20170576775; 20170530947; 20190242222; 20190234189; U.S. Pat. No. 10,309,199; 20190127290; 20190086189; 20190242209; 20180299239; 20180224260; U.S. Pat. No. 9,915,513; 20180038208; U.S. Pat. Nos. 9,822,618; 9,605,937; 20170074078; U.S. Pat. No. 9,581,422; 20170030693; 20160556132; 20160061572; U.S. Pat. No. 8,960,093; 20140033939; U.S. Pat. Nos. 8,267,012; 6,520,089; 20160115753; 20190178045; U.S. Pat. Nos. 10,365,079; 10,844,678; and 10,365,079, the entire contents of which are hereby incorporated by reference herein to the extent not inconsistent with the present disclosure. These downhole tools may be activated to perform the various procedures. Example procedures are provided in U.S. Pat. Nos. 11,078,763; 10,858,919; 10,036,236; 10,365,079; 7,409,987; 6,431,269; 3,713,393; 3,024,843; 2022/0145732; 2004/0134667; 20200072029; 20200048996; 20150345922; and 20160115753, the entire contents of which are hereby incorporated by reference herein to the extent not inconsistent with the present disclosure.

Despite advancements in downhole technology, there remains a need for efficient techniques for reliably activating downhole tools, even in harsh and/or compact downhole environments. The present disclosure is directed at providing such needs.

SUMMARY

In at least one aspect, the present disclosure relates to an igniter for activating a downhole component of a downhole tool, comprising an igniter housing, a switch assembly, and a propellant. The igniter housing positionable in the downhole tool. The igniter housing comprises an igniter portion and a nose portion. The igniter portion has a switch chamber therein. The nose portion has a propellant opening therethrough. The switch assembly is positioned in the switch chamber. The switch assembly comprises a switch movable between an untriggered and a triggered position. The propellant is supported by the nose portion. The propellant is connected to the switch and is ignitable thereby when the switch is moved to the triggered position whereby the propellant releases a pressurized fluid through the propellant opening to activate the downhole component.

In another aspect, the present disclosure relates to a downhole tool, comprising: a downhole component and an ignitor for activating the downhole component. The igniter housing positionable in the downhole tool. The igniter housing comprises an igniter portion and a nose portion. The igniter portion has a switch chamber therein. The nose portion has a propellant opening therethrough. The switch assembly is positioned in the switch chamber. The switch assembly comprises a switch movable between an untriggered and a triggered position. The propellant is supported by the nose portion. The propellant is connected to the switch and is ignitable thereby when the switch is moved to the triggered position whereby the propellant releases a pressurized fluid through the propellant opening to activate the downhole component.

In another aspect, the present disclosure relates to a method of activating a downhole component of a downhole tool. The method comprises positioning an igniter within the downhole component of the downhole tool, the igniter comprising an igniter housing, a switch assembly, and a propellant; positioning the downhole tool in a wellbore; and triggering the igniter to ignite the propellant by passing a trigger signal from a surface unit to the switch assembly such that the propellant is ignited and releases gas under pressure into the downhole component thereby shifting the downhole component.

In at least one aspect, the present disclosure relates to an igniter for activating a downhole component of a downhole tool. The igniter comprises an igniter housing; a switch assembly; and a propellant. The switch assembly may comprise a single or dual switch. The propellant may be positioned outside of or within the igniter housing.

In another aspect, the present disclosure relates to a downhole tool comprising a downhole component, and an igniter for activating the downhole component. The igniter comprises an igniter housing; a switch assembly; and a propellant. The igniter may be an integrated igniter positioned within the downhole component, or a remote igniter positioned outside the downhole component.

The downhole tool may be a setting tool. The setting tool may be activated by inserting the igniter into the setting tool; deploying the setting tool with the integrated igniter into the wellbore; triggering the integrated igniter by passing a trigger signal from a surface unit to the switch assembly such that the switch assembly ignites the propellant to release a gas into the setting tool with sufficient force to advance a piston in the setting tool and deploy a plug assembly.

Finally, in another aspect, the disclosure relates to a method of activating a downhole component of a downhole tool, such as a release tool, a setting tool, or other downhole component. The method comprises positioning the igniter about the downhole tool; positioning the downhole tool in the wellbore; and triggering the igniter.

This Summary is not intended to be limiting and should be read in light of the entire disclosure including text, claims and figures herein.

BRIEF DESCRIPTION OF THE DRAWINGS

So that the above recited features and advantages of the present disclosure can be understood in detail, a more particular description of the invention, briefly summarized above, may be had by reference to the embodiments thereof that are illustrated in the appended drawings. The appended drawings illustrate example embodiments and are, therefore, not to be considered limiting of its scope. The figures are not necessarily to scale and certain features, and certain views of the figures may be shown exaggerated in scale or in schematic in the interest of clarity and conciseness.

DETAILED DESCRIPTION

The description that follows includes exemplary apparatus, methods, techniques, and/or instruction sequences that embody techniques of the present subject matter. However, it is understood that the described embodiments may be practiced without these specific details.

This disclosure relates to an igniter for activating a downhole component of a downhole tool positionable in a wellbore at a wellsite. The igniter may include a switch assembly triggered from the surface to ignite a propellant and release a pressurized fluid (e.g., gas). The igniter may be used to generate pressure capable of activating (e.g., shifting, altering, driving, deploying, moving, etc.) one or more of the downhole components.

The combination of multiple downhole components formed into one assembly (e.g., a tool string) is referred to as a 'downhole tool.' The downhole tool may be a modular assembly including various combinations of multiple downhole components, such as a cable release, a collar locator, weight bars, a perforating tool (gun), a release tool, a setting tool, a plugging tool, an electronics hub, etc. One or more downhole components may be included in a single housing, or in separate housings of the downhole tool. The downhole components may be operatively (e.g., electrically and/or mechanically) connected together. One or more of the downhole components may operate separately or in concert.

The igniter and/or its igniter components may be shaped for compact and easy insertion into and removal from the downhole tool. Part or all of the igniter may be disposable for quick replacement and/or reuse. The igniter may be provided with various configurations, such as a single switch for single use activation, or a dual switch for multiple use activation. The igniter may also be provided with internal or external propellants depending on the desired configuration. The igniter may also be configured for connection to, insertion into, and/or integration with portions of the downhole tool and/or portions of one or more of the downhole components.

The present disclosure seeks to include one or more of the following features, among others: interchangeability with various tools, reduction in downtime, reduction in lost equipment, reliability, ballistic activation, operability in harsh downhole conditions, ease of manufacture and assembly, ability to couple to or integrate with existing components, operability with components of other tools for use therewith, reduction in cost, increased efficiency, elimination of redundant components, flexibility of use, ability to change configurations to match operational needs, ability to provide one or more activations, time savings, efficient operation, low maintenance costs, compact design, replaceable and/or disposable components, etc.

Figure 1:
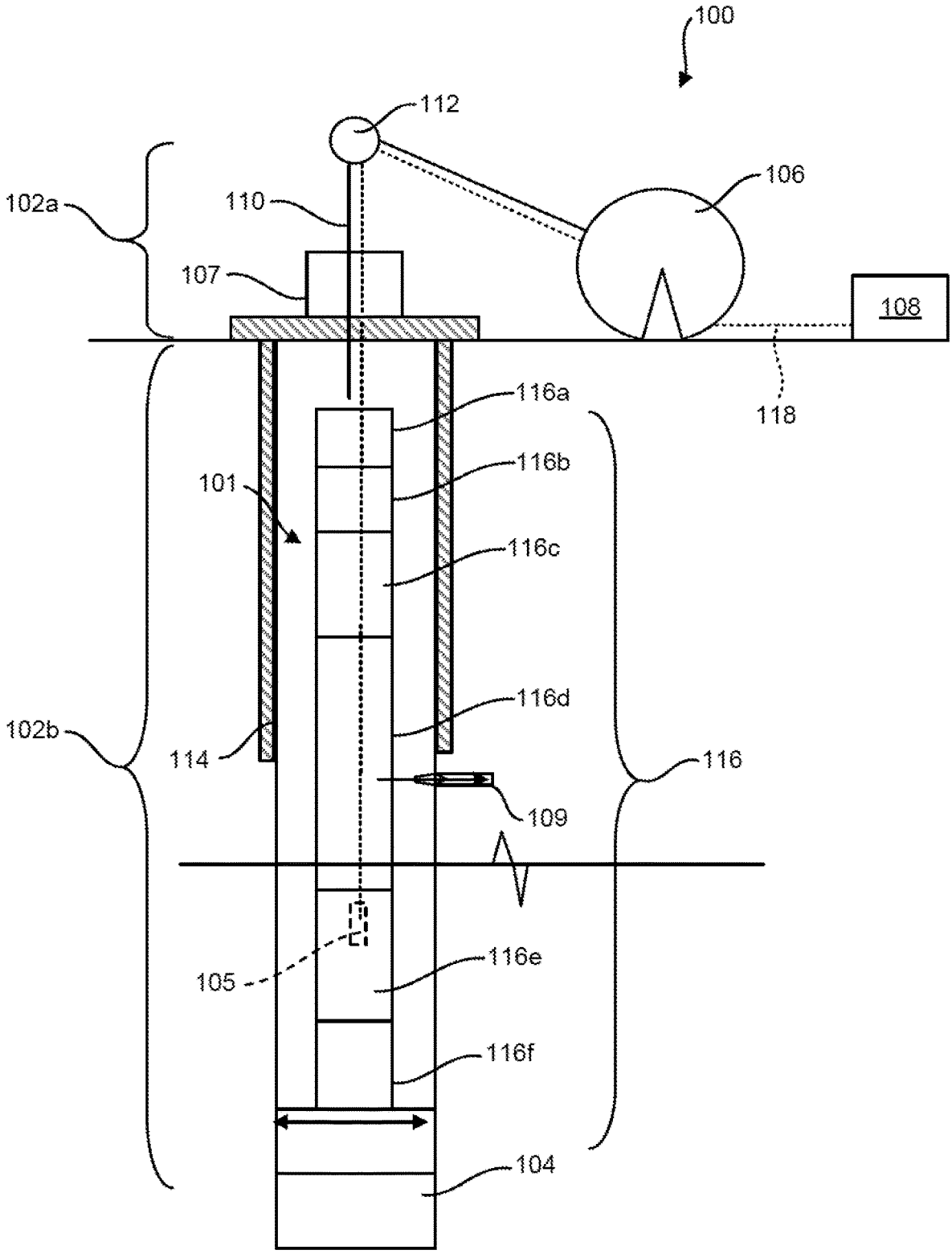
FIG. 1 is a schematic view of a wellsite with surface and downhole equipment, the downhole equipment comprising a downhole tool including an igniter.

FIG. 1 is a schematic view of a wellsite 100 with surface equipment 102*a* and downhole equipment 102*b*, the downhole equipment 102*b* comprising a downhole tool 101 including an igniter 105. The surface equipment 102*a* and the downhole equipment 102*b* are positioned about a wellbore 104 at the wellsite 100. The wellsite 100 may be any wellsite positioned about a subterranean formation, such as an unconventional formation (e.g., shale) with a reservoir (e.g., oil, gas, water, etc.) therein.

The surface equipment 102*a* includes a conveyance reel 106, and a surface unit 108. The surface equipment 102*a* may include a wellhead 107 (and other surface components) positioned about the top of the wellbore 104. The conveyance reel 106 may be a spool rotationally mounted at the surface. The conveyance reel 106 supports a conveyance 110 as it is deployed into the wellbore 104. A pulley 112 may optionally be provided to support the conveyance 110 about the wellbore 104 as schematically shown. In the example of FIG. 1, the conveyance 110 is a wireline cable electrically and communicatively coupled between the surface unit 108 and the downhole tool 101 for passing signals therebetween.

The downhole equipment 102*b* comprises the downhole tool 101 positioned in the wellbore 104 and supported therein by the conveyance 110. The wellbore 104 may have a casing 114 therein to line a surface of the wellbore 104. The downhole tool 101 may be deployed through the casing and into an open portion of the wellbore 104 via the conveyance 110 for performing downhole operations. The downhole tool 101 is provided with various downhole components 116 for performing such downhole operations.

FIG. 1 shows an example configuration of the downhole tool 101 that may be used with the igniter 105. In this example, the downhole tool 101 includes several downhole components 116 connected together to form a tool string. The downhole components 116 in this example include a cable head 116*a*, weight bars 116*b*, a collar locator 116*c*, a perforating tool 116*d*, a setting tool 116*e*, and a plug assembly 116*f*. Various arrangements of one or more of the downhole components 116*a-f* (and/or other downhole components 116, such as a release tool, electronics sub, etc. (not shown)) may be provided.

The downhole components 116 as shown are used to perform perforating various downhole operations. The cable head 116*a* may operatively connect the downhole tool 101 to the conveyance 110. The weight bars 116*b* may be provided to add weight to the downhole tool 101. The collar locator 116*c* may be used to locate portions of the casing 114, or other items along the wellbore 104. As schematically shown, the perforating tool 116*d* may be used to launch shaped charges to form perforations 109 along the wall of the wellbore 104. Examples of perforating tools are provided in U.S. Pat. No. 10,036,236; 20200072029; and 20200048996, previously incorporated by reference herein.

The setting tool 116*e* may be coupled to the plug assembly 116*f* for use therewith. The setting tool 116*e* may be activated to deploy a plug from the plug assembly 116*f* (as indicated by the double arrow) to anchor the downhole tool 101 along the wellbore 104. Examples of techniques for setting and plugging are described in US Patent Application No. 20190242209; U.S. Pat. Nos. 10,365,079; 10,844,678; and U.S. Pat. No. 3,024,843, previously incorporated by reference herein.

The igniter 105 may be positioned in various locations about the downhole tool 101 for use with various of the downhole components 116. For example, the igniter 105 may be in an integrated configuration within the setting tool 116*e* for activating the setting tool 116*e*. The igniter 105 may also be in a remote configuration such that the igniter 105 is positioned separate from the setting tool 116*e* as described further herein. The igniter 105 may be used to selectively activate the setting tool 116*e* to deploy the plug assembly 116*f* as is described further herein.

The igniter 105 may be communicatively coupled by a communication link 118 to the surface to receive signals therefrom. In the example shown in FIG. 1, the communication link 118 extends from the surface unit 108 and to the downhole tool 101 via the conveyance 110. The communication link 118 extends through the downhole components 116 and to the igniter 105. The surface unit 108 may be provided with personnel (e.g., operators) and/or electronics (e.g., central processing units (CPUs), controllers, etc.) for sending trigger signals via the communication link 118 to the igniter 105. Once triggered, the igniter 105 activates the setting tool 116*e* to deploy the plug assembly 116*f* as is described further herein.

While FIG. 1 shows a certain configuration of the wellsite 100, the surface equipment 102*a*, and the downhole equipment 102*b*, various configurations may be used. For example, one or more communication links 118, surface units 108, and/or other devices may be provided for triggering the igniter 105 and activating the setting tool 116*e*. In another example, the downhole tool 101 may have one or more of the downhole components 116 in use with one or more remote and/or integrated igniters 105. Additionally, while not shown, it will be appreciated that the igniter 105 may also be coupled to other downhole components 116 and/or portions of the downhole tool 101 for activation. It will also be appreciated that, while the descriptions herein refer to certain uphole and downhole positions, such positions may optionally be reversed.

Figure 2:
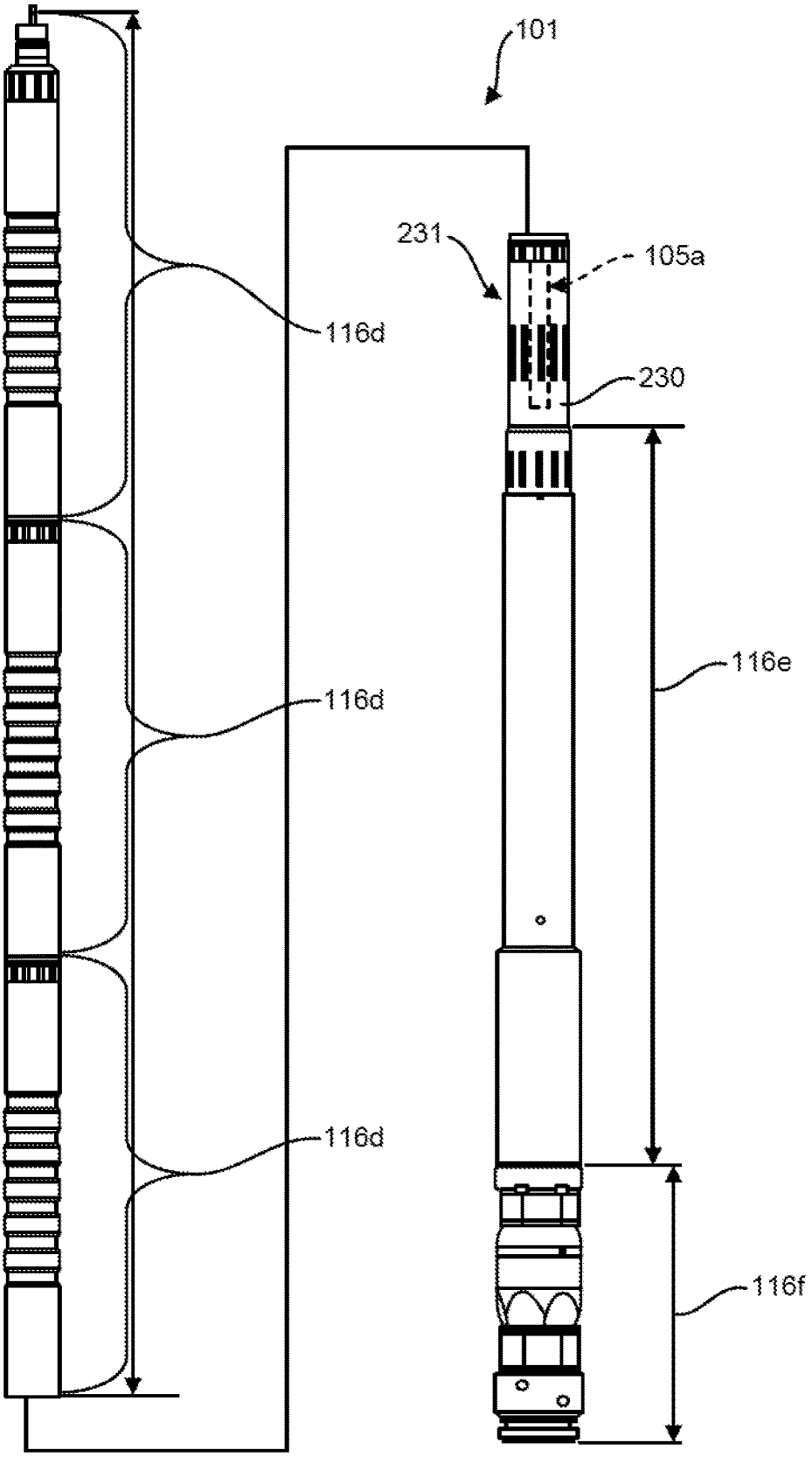
FIG. 2 is a side view of a portion of the downhole tool including a perforating tool, a remote igniter, a setting tool, and a plug assembly.
Figure 3A:
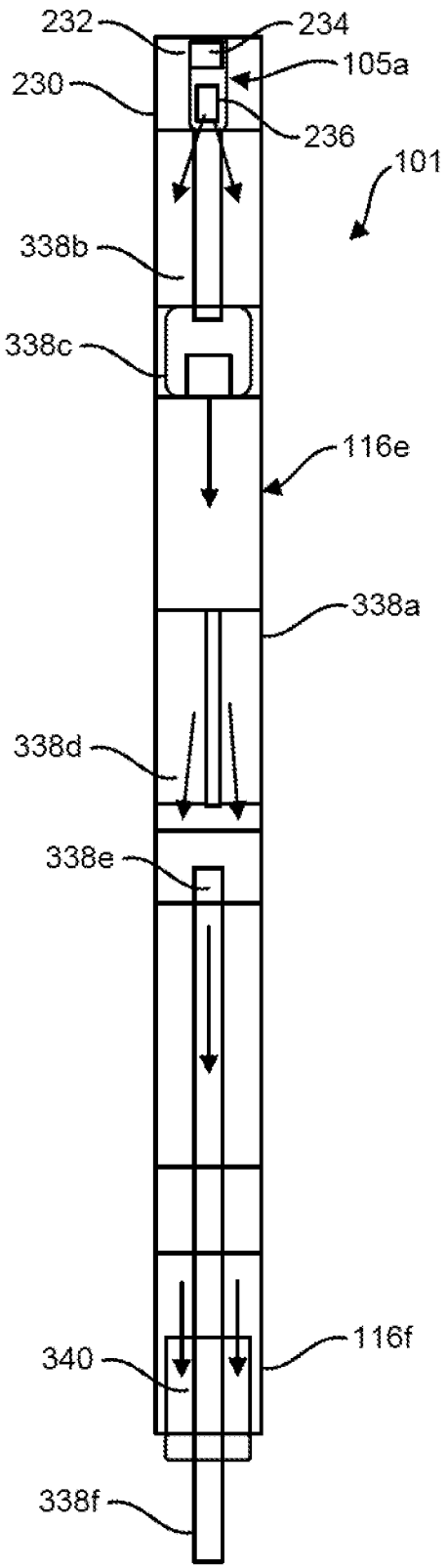
FIGS. 3A and 3B are schematic longitudinal, cross-sectional views of a portion of the downhole tool including the remote igniter, the setting tool, and the plug assembly, before and after activation by the remote igniter, respectively.
Figure 3B:
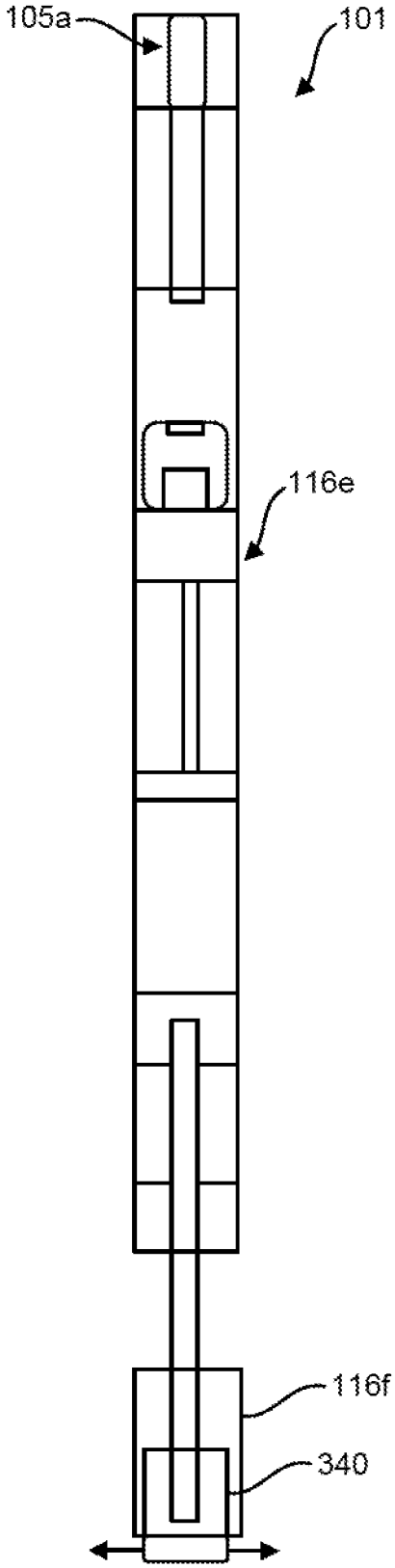

FIGS. 2 and 3A—3B show the remote igniter 105*a* in a remote configuration in the downhole tool 101. FIG. 2 is a side view of a portion of the downhole tool 101 including the perforating tool 116*d*, the remote igniter 105*a*, the setting tool 116*e*, and the plug assembly 116*f*. FIGS. 3A and 3B are schematic, longitudinal, cross-sectional views of a portion of the downhole tool 101 including the remote igniter 105*a*, the setting tool 116*e*, and the plug assembly 116*f*, before and after activation by the remote igniter 105*a*, respectively. These figures show the remote igniter 105*a* connected to the setting tool 116*e* for activation of the setting tool 116*e* and the plug assembly 116*f*.

FIGS. 2 and 3A—3B show an example configuration of a downhole components 116 usable with the downhole tool 101 (FIG. 1). As demonstrated by FIG. 2, the downhole tool 101 be provided with multiple (e.g., three) perforating tools 116*d* connected together end to end. As also demonstrated by FIGS. 2 and 3A—3B, the remote igniter 105*a* may be located in a remote position outside of the setting tool 116*e*. In this example, the remote igniter 105*a* is positioned between perforating tool 116*d* and the setting tool 116*e*, and the setting tool 116*e* is positioned between the remote igniter 105*a* and the plug assembly 116*f*. The remote igniter 105*a* is also positioned within an outer housing 230. The outer housing 230 is connectable at one end to the perforating tool 116*d* and at another end to the uphole end of the setting tool 116*e*. The remote igniter 105*a* and the outer housing 230 may form a remote assembly 231 connectable to various downhole components 116 for activation thereof.

As shown in greater detail in FIGS. 3A and 3B, the remote igniter 105*a* includes an igniter housing 232, a switch assembly 234, and an internal propellant 236. The igniter housing 232 is a tubular member shaped for insertion into the outer housing 230. The igniter housing 232 is also shaped to house and protect the switch assembly 234 and the propellant 236. The switch assembly 234 is positioned in the igniter housing 232 and is coupled by the communication link 118 to the surface unit 108 for receiving trigger signals (FIG. 1). The switch assembly 234 is also coupled to the propellant 236 for igniting the propellant 236. Once ignited, the propellant 236 explodes and generates pressurized fluid. The propellant 236 may be any explosive device commonly used in downhole wireline tools.

As also shown in greater detail in FIGS. 3A and 3B, the setting tool 116*e* includes a setting housing 338*a*, a propellant chamber 338*b*, a drive piston 338*c*, an oil chamber 338*d*, a plug piston 338*e*, and a plug tube 338*f*. The setting housing 338*a* may be a tubular housing shaped to house the propellant chamber 338*b*, the drive piston 338*c*, the oil chamber 338*d*, and the plug piston 338*e*. The setting housing 338*a* may be a unitary piece, or modular pieces. This configuration may be used to provide a modular setting tool 116*e* and remote igniter 105*a* that may be connectable separately to the perforating tool 116*d* (or other downhole component 116 (FIG. 1)).

The drive piston 338*c* is slidably positionable in the setting housing 338*a*. The propellant chamber is a cavity positioned upstream of the drive piston 338*c*. The oil chamber 338*d* is a fluid filled cavity positioned downstream of the drive piston 338*c* for housing a hydraulic fluid. The plug piston 338*e* is slidably positioned in the setting housing 338*a* downstream of the drive piston 338*c*. The plug tube 338*f* is operatively connected to the plug 340. The plug 340 is slidably positionable on the plug piston 338*e*.

Once the remote igniter 105*a* is activated, the remote igniter 105*a* explodes the propellant 236 and generates the pressurized fluid that is passed into the propellant chamber 338*b* as indicated by the arrows. The pressure of the pressurized fluid is sufficient to apply a force to drive the drive piston 338*c* downhole as indicated by the arrow. Movement of the drive piston 338*c* also pushes the plug piston 338*e* downhole. Fluid (e.g., hydraulic fluid) in oil chamber 338*d* cushions movement of the plug piston 338*e*. The downhole movement of the plug piston 338*e* drives the plug assembly 116*f* downhole along the plug tube 338*f* to a position where the plug 340 may expand to seal the wellbore 104 (FIGS. 1 and 3B).

Figure 4A:
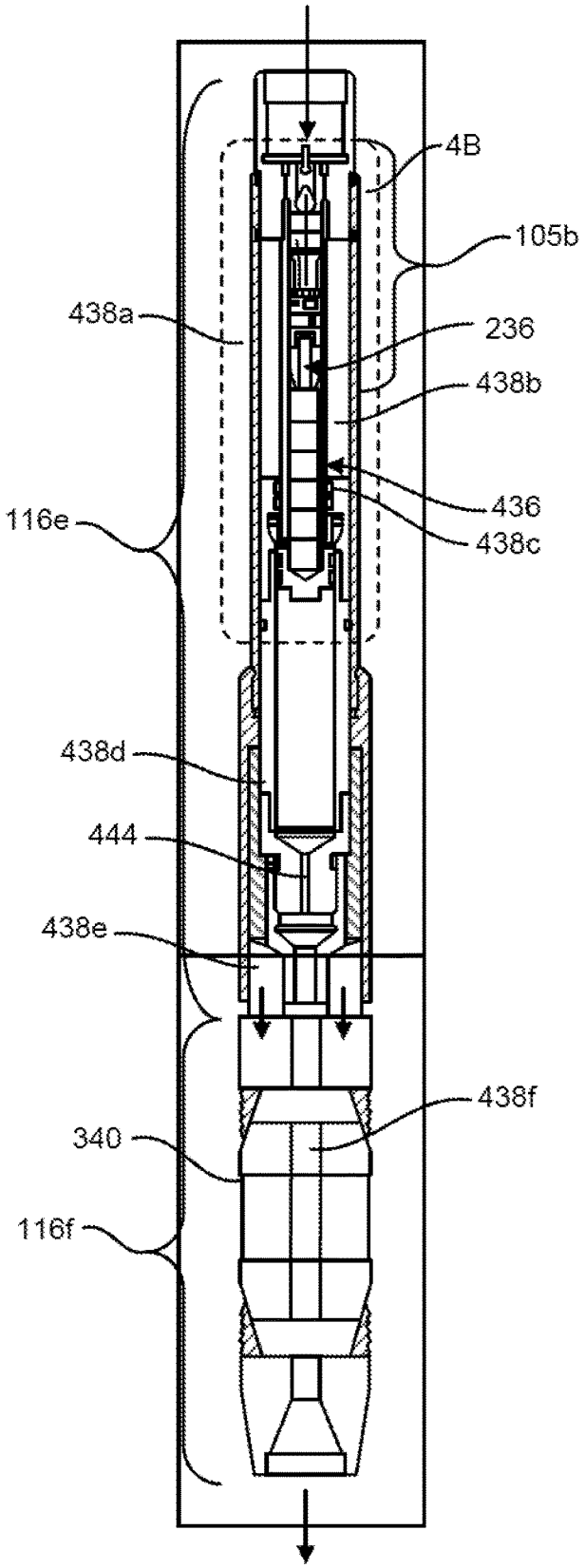
FIGS. 4A-4C are cross-sectional views of various portions of another version of the setting tool with an integrated igniter before activation.
Figure 4B:
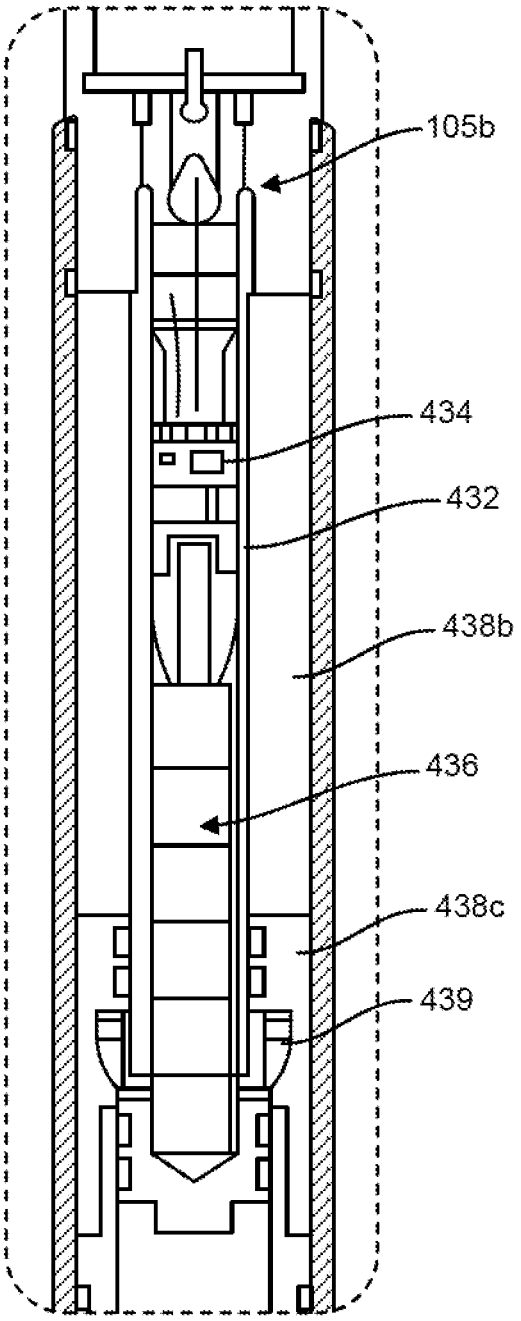
Figure 4C:
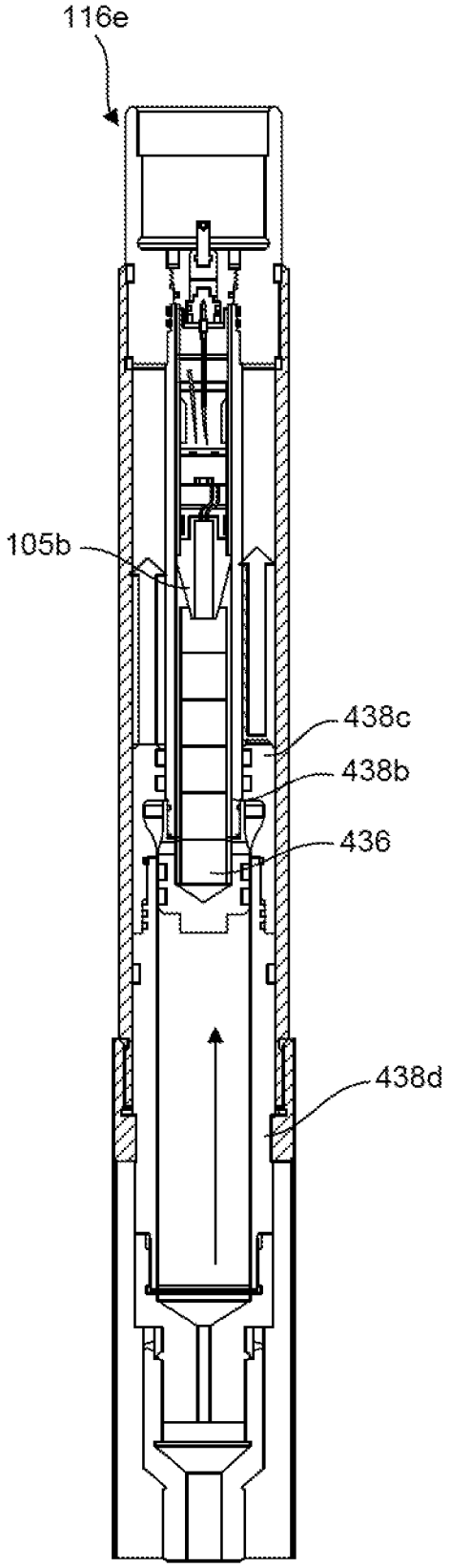
Figure 4D:
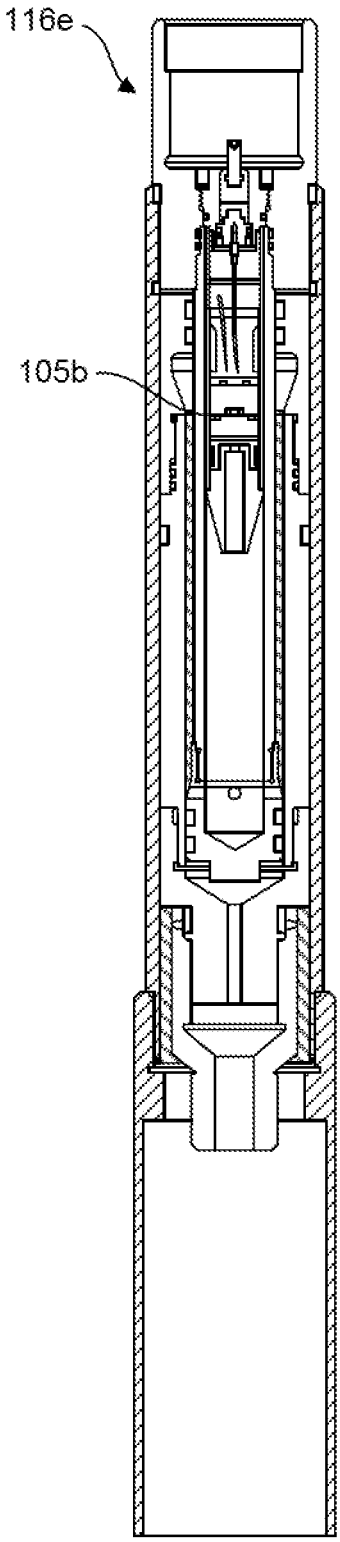
FIG. 4D is a cross-sectional view of the setting tool of FIG. 4C with the integrated igniter after activation.

FIGS. 4A-4D show the integrated igniter 105*b* in an integrated configuration within the setting tool 116*e* and the plug assembly 116*f*. FIGS. 4A-4C are cross-sectional views of various portions of another version of the setting tool 116*e* with an integrated igniter 105*b* before activation. FIG. 4D is a cross-sectional view of the setting tool 116*e* with the integrated igniter 105*b* after activation. These figures show example configurations of the integrated igniter 105*a*, the setting tool 116*e*, and the plug assembly 116*f*. These figures also show the integrated igniter integrated into the setting tool 116*e* for ballistic activation of the setting tool 116*e* and to perform a setting operation. This configuration may be used to provide a unitary setting tool 116*e* capable of setting the plug assembly 116*f*. This configuration also shows an integrated configuration used to activate portions of the downhole tool 101, such as the setting tool 116*e* and the plug assembly 116*f* (and/or other downhole components 116) (FIG. 1).

As shown in FIGS. 4A, the setting tool 116*e* includes a setting housing 438*a*, a propellant chamber 438*b*, a drive piston 438*c*, a fluid chamber 438*d*, a plug piston 438*e*, and a plug tube 438*f*. The setting housing 438*a* may be a tubular housing shaped to house the propellant chamber 438*b*, the drive piston 438*c*, the fluid chamber 438*d*, and the plug piston 438*e*. The setting housing 438*a* and the propellant chamber 438*b* may optionally be modified (e.g., extended, widened, etc.) to a shape capable of receiving the integrated igniter 105*b* therein, or the integrated igniter 105*b* may be shaped to fit within pre-existing setting housing 438*a*. This configuration may be used to provide a unitary setting tool 116*e* connectable to the perforating tool 116*d* (or other downhole component 116 (FIG. 1)).

The drive piston 438*c* is slidably positioned in the setting housing 438*a*. The drive piston 438*c* is movable uphole by the ignition pressure released by ignition of the propellant 236 into a piston cavity 439. The plug piston 438*e* is coupled to the drive piston 438*c*. The plug piston 438*e* is also slidably movable within the setting housing 438*a*. Movement of the drive piston 438*c* causes the igniter housing 432 to advance into the fluid chamber 438*d*, and the plug piston 438*e* to move uphole with the drive piston 438*c*. The fluid chamber 438*d* has a fluid cavity 444 with fluid (e.g., gas) therein that is used to cushion movement of the drive piston 438*c*.

The plug piston 438*e* is coupled to the plug tube 438*f* and moveable therewith. Movement of the plug piston 438*e* causes the plug tube 438*f* to move uphole as the drive piston 438*c* and the plug piston 438*e* move uphole. As the plug tube 438*f* moves uphole, the plug 340 expands to form a seal with a wall of the wellbore 104 (FIG. 1).

As shown FIGS. 4A-4C, the integrated igniter 105*b* extends into the uphole end of the setting tool 116*e*. The integrated igniter includes an igniter housing 432, a switch assembly 434, and an external propellant 436. The integrated igniter may also include the internal propellant 236. The igniter housing 432 is a tubular member shaped for insertion into the setting tool 116*e*. The igniter housing 232 is also shaped to house and protect the switch assembly 434. The switch assembly 434 is positioned in the igniter housing 432 and is coupled by the communication link 118 to the surface unit 108 for receiving trigger signals (FIG. 1). The switch assembly 434 is also coupled to the external propellant 436 for igniting the propellant 436. In this example, the internal propellant 436 is positioned internal to the igniter housing 432 and the external propellant 436 is positioned external to the igniter housing 432 of the integrated igniter 105*b*.

The integrated igniter 105 is receivably positioned in the setting tool 116*e*. An uphole end of the integrated igniter 105 is electrically connectable to an adjacent downhole component, such as the perforating tool 116*d*, thereby forming part of the communication link 118 (FIG. 1). An electrical pathway may be defined by the communication link 118 for sending a trigger signal from the surface unit 108, through the downhole components 116*a-d*, and to the integrated igniter 105. A downhole end of the integrated igniter 105 may also be electrically connected to the setting tool 116*e*, thereby extending the communication link 118 through the setting tool 116*e* and to the other downhole components 116. The integrated igniter 105 is activatable by the trigger signal to ignite the external propellant 436, thereby releasing pressurized fluid (e.g., gas) into the piston cavity (pressure chamber) 439. This pressure may be used to drive the drive piston 438*c*, thereby activating the setting tool 116*e* to deploy the plug assembly 116*f*.

As shown by FIGS. 4A-4D, once triggered, the integrated igniter 105 ignites the internal propellant 236 and/or the external propellant 436 and releases a pressurized fluid through the piston cavity 439 and against the drive piston 438*c*. The pressurized gas applies a force to advance the drive piston 438*c* from the inactivated position of FIGS. 4A-4C to the activated position of FIG. 4D. Uphole movement of the drive piston 438*c* also moves the plug piston 438*e*, and applies a force to the plug assembly 116*f* to push the plug 340 downhole along the plug tube 438*f* to a position where the plug 340 may expand to engage the wall of the wellbore 104 (FIG. 1). The downhole movement of the plug piston 438*e* drives the plug assembly 116*f* downhole along the plug tube 438*f*, and allows the plug 340 to expand to seal the wellbore 104 (see, e.g., FIGS. 1 and 3B).

Figure 5A:
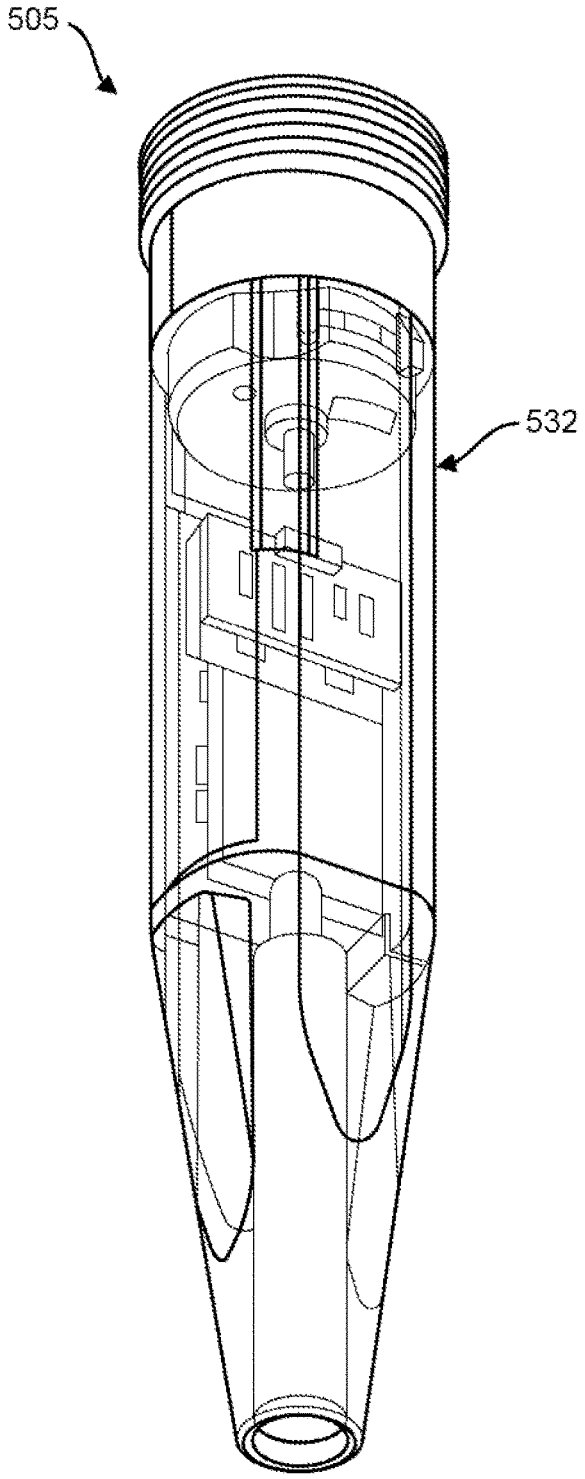
FIGS. 5A-5C are hidden, partial cross-sectional, and exploded views, respectively, of the igniter with a single switch assembly.

FIGS. 5A-7C show various versions of the igniter 505, 605, and 705. Any of these versions of the igniter 505, 605, 705 may be used as the igniter 105, the remote igniter 105*a* or the integrated igniter 105*b* as described herein. FIGS. 5A-5C show a single contact version of the igniter 505, and FIGS. 6A-6C show a dual contact version of the igniter 605. These versions have the propellant 236 in an internal position. These versions also may not require a locking or screw or support about the propellant 236.

Figure 5B:
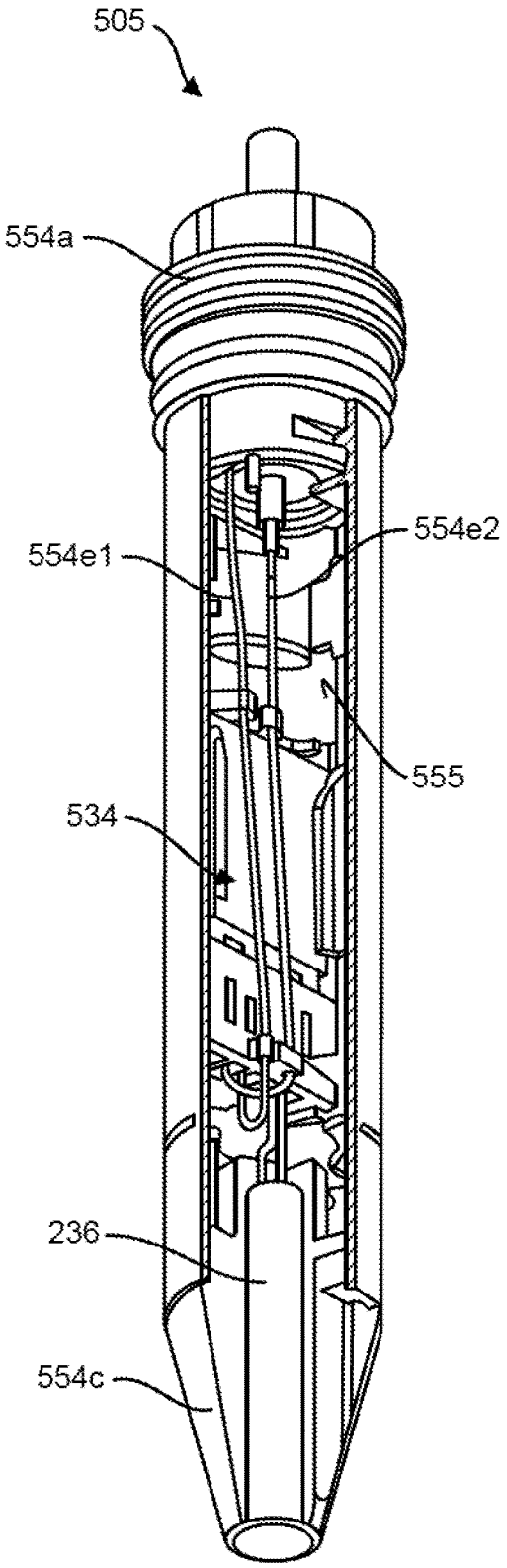
Figure 5C:
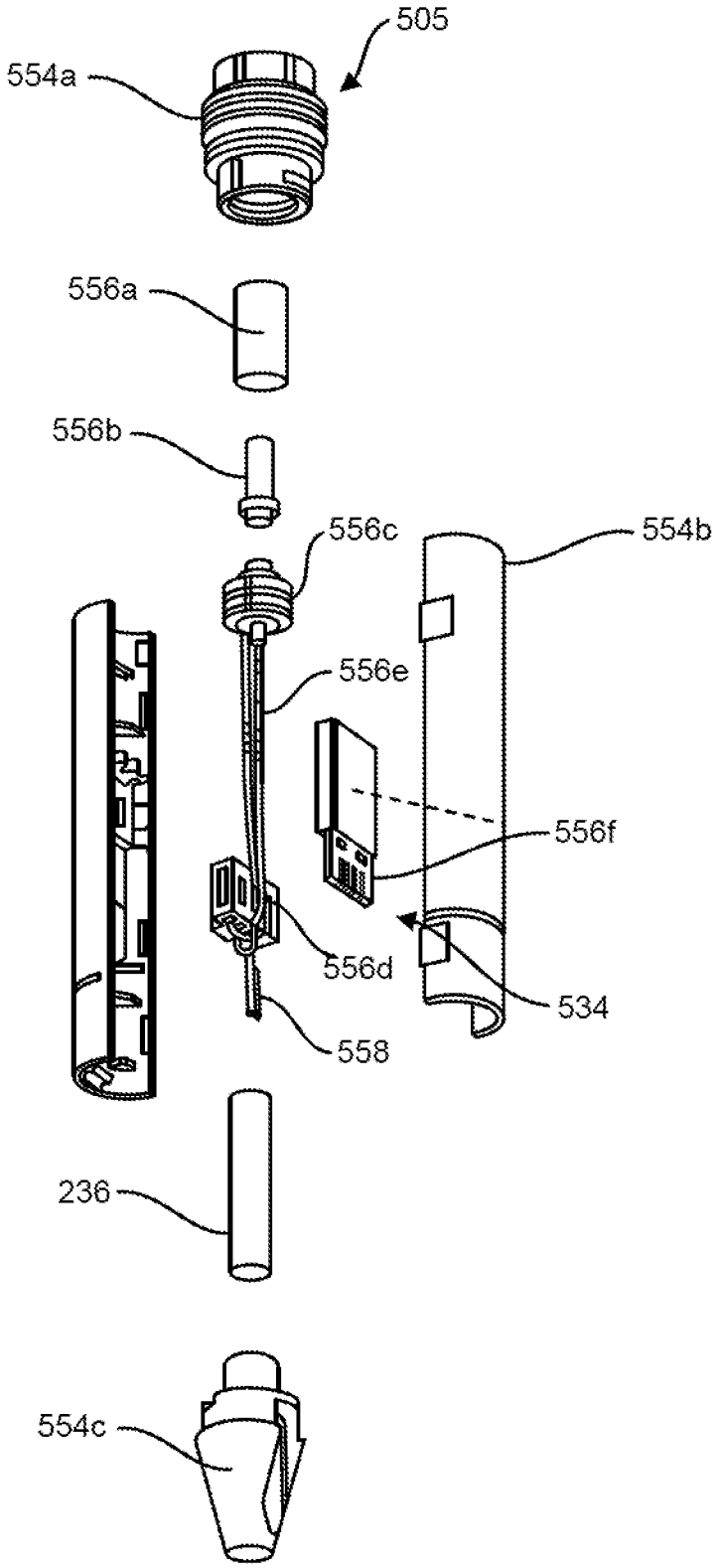

FIGS. 5A-5C are hidden, partial cross-sectional, and exploded views, respectively, of the igniter 505 with a single switch assembly 534. In this version, the igniter 505 includes an igniter housing 532, the switch assembly 534, and an internal propellant 236. The igniter housing 532 includes a bulkhead (or uphole connector) 554*a*, igniter portions 554*b*, and a nose cone 554*c*. The igniter housing 532 may be shaped for insertion into the outer housing 230 (see, e.g., FIGS. 2 and 3A—3B) or within the setting tool 116*e* (see, e.g., FIGS. 4A-4D).

The bulkhead 554*a* is a cylindrical member with threads thereon for threaded connection to the downhole component 116 (e.g., the setting tool 116*e* of FIGS. 2 and 3A—3B, 4A—4C). The nose cone 554*c* is a tapered member with a passage for extension of the internal propellant 236 therethrough. The igniter portions 554*b* are curved portions that form a tubular member when joined together. The igniter portions 554*b* are attached to the bulkhead 554*a* at one end and the nose cone 554*c* at an opposite end to form a switch chamber 555 for receiving the switch assembly 534 therein. The nose cone 554*c* may be shaped for easy removal and for easy access to the propellant 236 to facilitate replacement of the propellant 236 after use or as needed, and/or to facilitate access into the igniter 505.

The switch assembly 534 is supported within the igniter housing 532. The switch assembly 534 includes an insulator 556*a*, a plunger 556*b*, a plunger plug 556*c*, a single igniter plug 556*d*, wires 556*e*, and a single addressable switch 556*f*. The insulator 556*a* is a tubular, spring-loaded member connected to the bulkhead 554*a*. The insulator 556*a* is made of a non-conductive material to prevent electrical contact between the bulkhead 554*a* and the switch assembly 534. The plunger 556*b* is positioned in the insulator 556*a* and extends therefrom for connection to the plunger plug 556*c*.

The plunger 556*b* may be an electrical connector for connecting the switch assembly 534 to other portions of the downhole tool 101 for communication therewith. For example, the plunger 556*b* may extend through the bulkhead 554*a* for electrical connection to the perforating tool 116*d* (FIG. 1), and/or to the communication link 118. The wires 556*e* may be electrically connected to other downhole components 116, the communication link 118, the conveyance 110, the surface unit 108, etc. (FIG. 1). In this manner, the switch assembly 534 may be electrically connected to the surface for receipt of a trigger signal.

The plunger plug 556*c* is an electrical connector supported in the igniter 505. The plunger plug 556*c* is electrically connectable to the plunger 556*b* at one end, and to the single igniter plug 556*d* by the wires 556*e* at the other end. The wires 556*e* may include a ground wire 554*e*1 and a surface link wire 554*e*2. The ground wire 554*e*1 may be coupled to the bulkhead 554*a*. The surface link wire 554*e*2 may be electrically connected to the plunger 556*b*.

The single igniter plug 556*d* is an electrical connector supported in the igniter 505. The single igniter plug 556*d* is electrically connected to the addressable switch 556*f* by a plug contact 558. In this version, the addressable switch 556*f* is a single switch and the plug contact 558 is a single contact. The single addressable switch 556*f* is electrically connected with the surface unit 108 via the single igniter plug 556*d*, the wires 556*e*, and the plunger 556*b* (which is in communication with the surface unit 108 as described herein).

The single addressable switch 556*f* is also electrically connected with the propellant 236 via the plug contact 558. The internal propellant 236 is also positioned within the igniter housing 532. The propellant 236 is shown as a tubular member supported within the nose cone 554*c* and extendable therethrough. The propellant 236 may include one or more individual power packs of combustible material ignitable by an electrical charge applied by the addressable switch 556*f*. The single addressable switch 556*f* may be used for a single ignition of the integrated igniter 505.

Figure 6A:
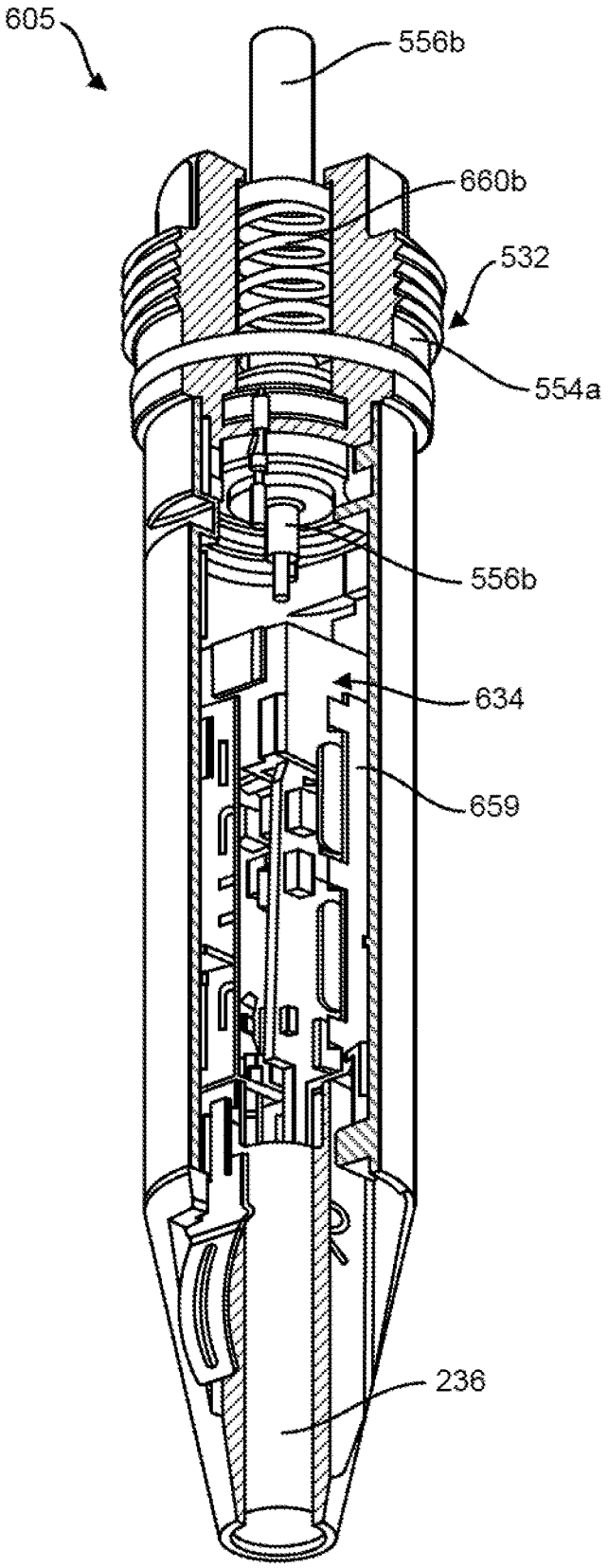
FIGS. 6A and 6B are partial cross-sectional and exploded views, respectively, of the igniter with a dual switch assembly.
Figure 6B:
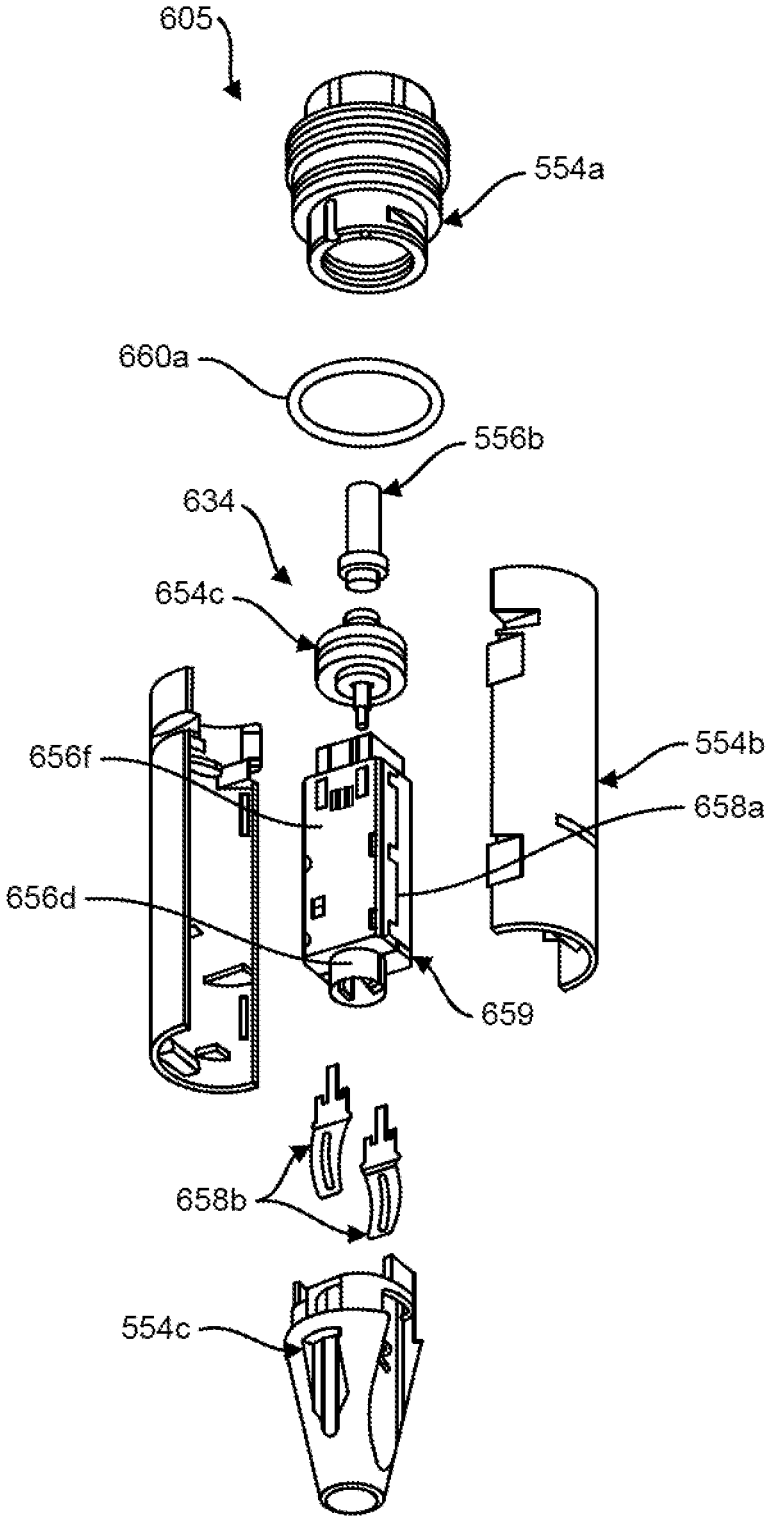

FIGS. 6A and 6B are partial cross-sectional and exploded views, respectively, of the igniter 605 with a dual switch assembly 634. This version is similar to the igniter 505 of FIGS. 5A-5C with the same igniter housing 532 (with bulkhead 554*a*, igniter portions 554*b*, and nose cone 554*c*), without an insulator 556*a*, and with a different switch assembly 634.

In this version, the dual switch assembly 634 includes the same plunger 556*b*, and wires 556*e* (as shown in FIGS. 5A-5C). This switch assembly 634 also includes a switch housing 659, an o-ring 660*a*, compression spring 660*b*, plunger plug 654*c*, a dual igniter plug 656*d*, and a dual addressable switch 656*f*. The plunger plug 654*c* includes a plunger plate 658*a* and dual plug contacts 658*b*. The o-ring 660*a* is positioned between the bulkhead 554*a* and the igniter portions 554*b*. The plunger 556*b* is supported in the bulkhead 554*a* by the compression spring 660*b*. The compression spring 660*b* is positioned within the bulkhead 554*a* between the plunger 556*b* and the plunger plug 654*c*.

The plunger plug 654*c* is an insulated feed thru supported in the igniter portions 554*b*. The switch housing 659, the plunger plug 654*c*, the dual igniter plug 656*d*, and the wires 556*e* are also supported in the igniter portions 554*b*. This switch housing 659 may enclose and/or support one or more components of the switch assembly 634 (e.g., plugs 656*c,d* and wires 556*e*) for easy removal and replacement after use or as needed.

The plunger plug 654*c* electrically connects the plunger 556*b* to the dual igniter plug 656*d*. The dual igniter plug 656*d* is electrically connected to the dual plug contact 658*b* and to the dual addressable switch 656*f*. The dual addressable switch 656*f* is connected to the internal propellant 236 by the dual plug contacts 658*b*. The addressable switch 656*f* has dual contacts 658*b* for redundant contact with the propellant 236. The dual addressable switch 656*f* may be used for a dual ignition of the integrated igniter 505. As demonstrated by this example, one or more contacts 558, 658*b* may be used to provide redundant electrical connection with the propellant 236 to further assure ignition.

Figure 7A:
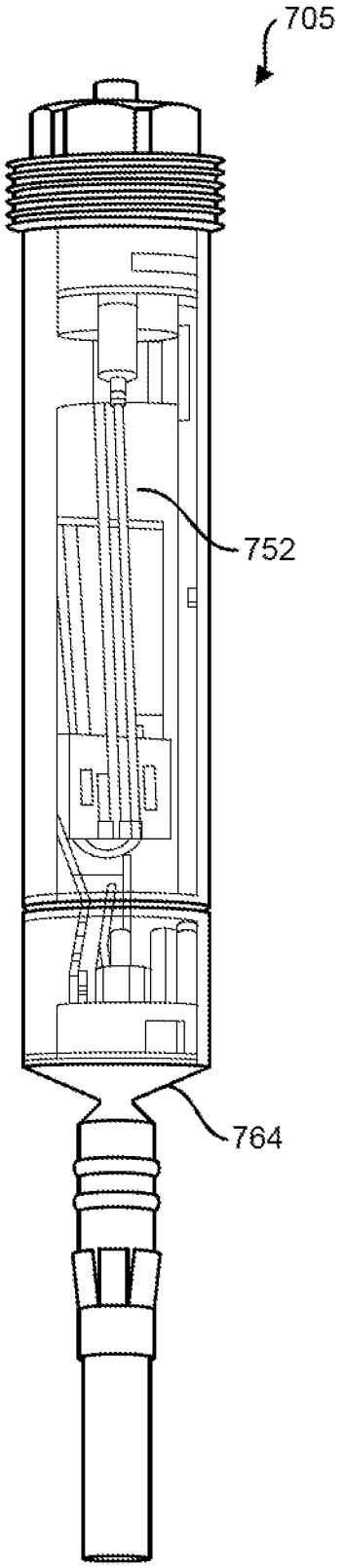
FIGS. 7A-7C are hidden, cross-sectional, and exploded views, respectively, of a locking version of the igniter with a single switch assembly and an external propellant.
Figure 7B:
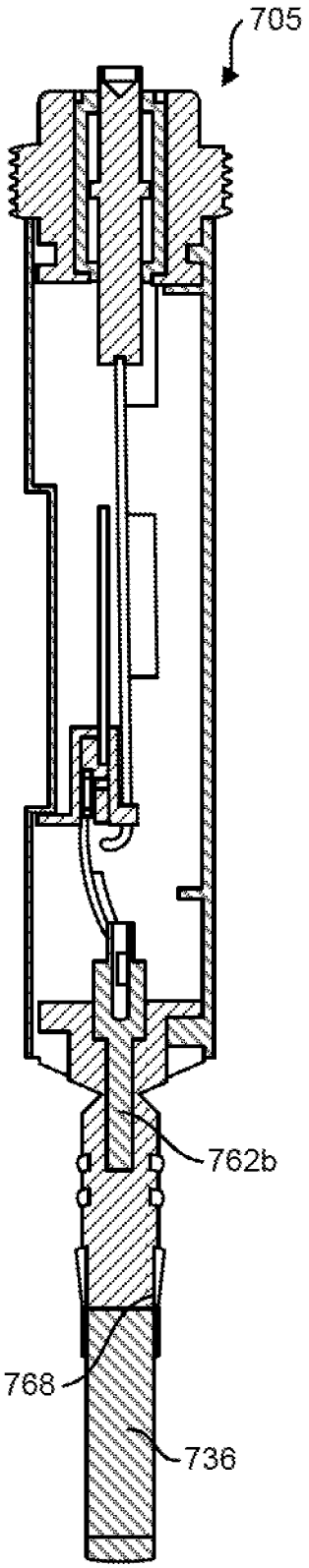
Figure 7C:
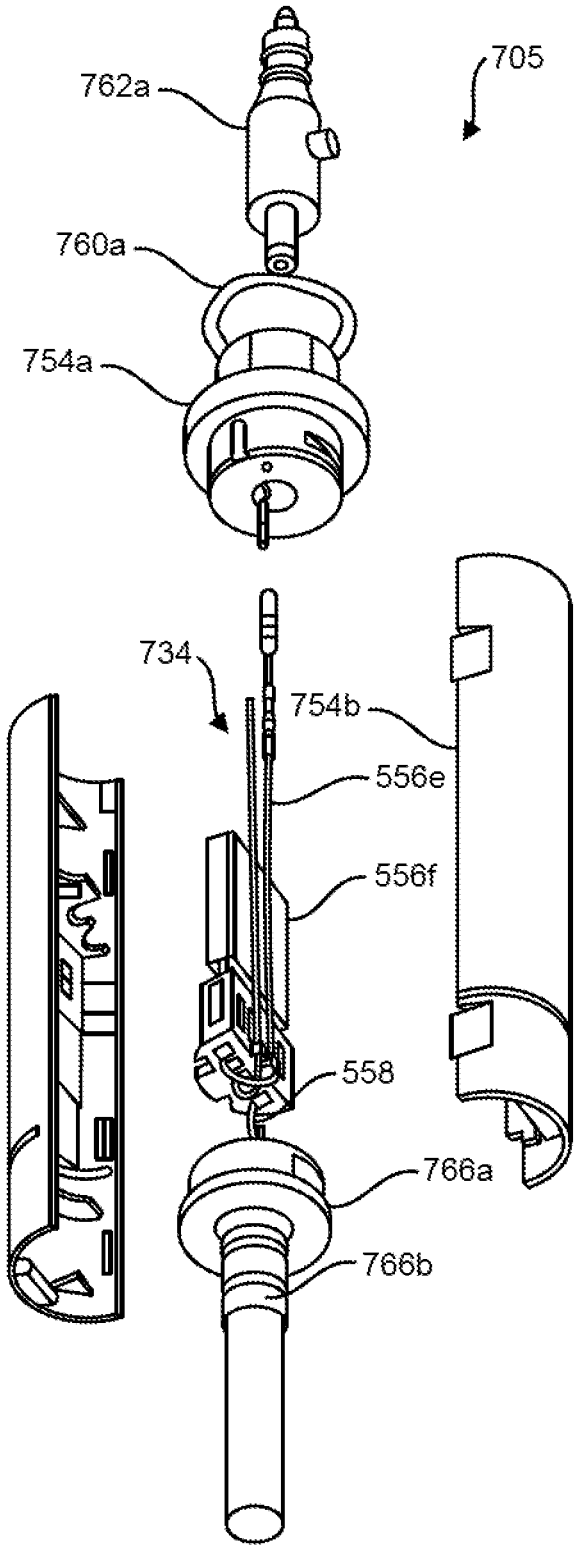

FIGS. 7A-7C are hidden, cross-sectional, and exploded views, respectively, of a locking (e.g., screw on) version of the igniter 705 with the single switch assembly 734 and the external propellant 736. This version has the external propellant 736 supported by the igniter 705, and in an external position outside of the igniter housing 752.

Like the integrated igniters 505 of FIGS. 5A-5C and 605 of FIGS. 6A and 6B, this version includes an igniter housing 752, the switch assembly 734, and the external propellant 736. In this version, the igniter housing 752 is a cylindrical member with the external propellant 736 external thereto. A demonstrated by this version, the igniter housing 752 may have different shapes, and may support the external propellant 736 external from other components housed within the igniter housing 752. The external propellant 436 may also be provided separate from the igniter 505 as shown in FIGS. 4A-4C.

In this version, the igniter housing 752 includes a bulkhead 754*a* and igniter portions 754*b*. The igniter portions 754*b* are similar to the igniter portions 554*b* of FIGS. 5A-5C. An o-ring 760*a* is positionable about the bulkhead 754*a*. The bulkhead 754*a* operates similar to the bulkheads 554*a* of FIGS. 5A-5C for communication via communication link 118 (FIG. 1).

The switch assembly 734 is positioned within the igniter portions 754*b*, and includes the same addressable switch 556*f*, single contact 558, and wires 556*e* of the switch assembly 534 of FIGS. 5A-5C. This switch assembly 734 also includes a bulkhead feedthru 762*a* and a nose feedthru 762*b*. The bulkhead feedthru 762*a* is extendable through the bulkhead 754*a*. The wires 556*e* are electrically connectable to the bulkhead feedthru 762*a* at one end and the single contact 558 at the other end. The single contact 558 is connectable to the nose feedthru 762*b*. The bulkhead feedthru 762*a* extends through the bulkhead 754*a* for connection to the wires 556*e* at one end and to another downhole component, such as the perforating tool 116*d* for communication with the conveyance 110 and the surface unit 108 (FIG. 1).

This version may also employ locking means (e.g., a locking or screw or support) about the external propellant 736. A locking ring 764 positioned at a downhole end of the igniter portions 754*b*. The propellant 236 is secured to the housing 752 by the locking ring 764, and extends from an end of the igniter housing 752 for insertion into the downhole tool (e.g., into propellant chamber 438*b* of the setting tool 116*e* (see, e.g., FIG. 4B)).

The locking ring 764 may be used to secure the propellant 236 to the igniter 505. The locking ring 764 is a ring-shaped member including a housing portion 766*a* and a nose portion 766*b* extending downhole therefrom. The housing portion 766*a* may be threaded for connection to the igniter portions 754*b*. The housing portion 766*a* may also have a hole to receive the nose feedthru 762*b* therethrough.

The nose feedthru 762*b* extends into the nose portion 766*b* for connection to the switch assembly 734. The nose portion 766*b* has a nose receptacle 768 for receivingly supporting the propellant 436 therein. Upon triggering of the switch assembly 734, a signal passes from the switch assembly 734 via the nose feedthru 762*b* to ignite the propellant 236, thereby activating the downhole component (e.g., activating setting tool 116*e* to deploy the plug assembly 116*f*).

Figure 8:
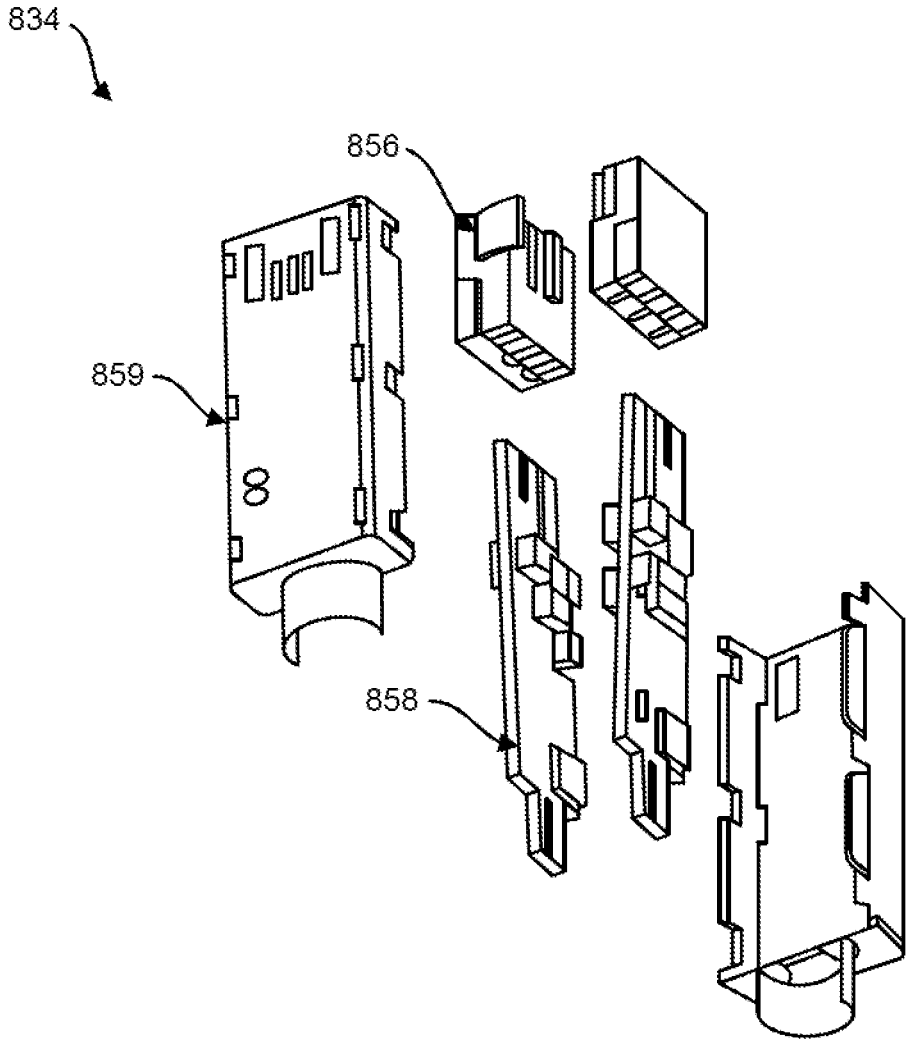
FIG. 8 is an exploded view of the dual switch assembly.

FIG. 8 is an exploded view of the dual switch assembly 834. This dual switch assembly 834 may be used with any of the igniters described herein. In this example, the dual switch assembly 834 includes a switch housing 859, dual contacts 858, and dual igniter plugs 856. The switch housing 859 has two pieces that combine to enclose the dual contacts 858 and the dual igniter plugs 856. The dual igniter plugs 856 and the dual contacts 858 are supported in the switch housing 859 for connection to other portions of the igniter used therewith. For example, the dual contacts 858 may be supported in the dual igniter plugs 856 for connection to the nose cone 554*c* of FIGS. 5A-5C. In another example, the dual igniter plugs 856 may be supported in the switch housing 859 for connection to the wires 556*e* of FIG. 5A for electrical connection to the plunger plug 556*c*. Other electronic components may be provided in the switch assembly 834 for enabling communication necessary to ignite the propellant 236, 436, 736.

While specific configurations of the setting tool and the integrated igniter integrated therewith are shown, it will be appreciated that various configurations of the integrated igniter and the setting tool may be provided. It will also be appreciated that each of the igniters described herein may include one or more features of the other igniters described herein. For example, one or more wires, connectors, contacts, propellants, portions of housings, shapes of components, etc. can be provided.

Figure 9:
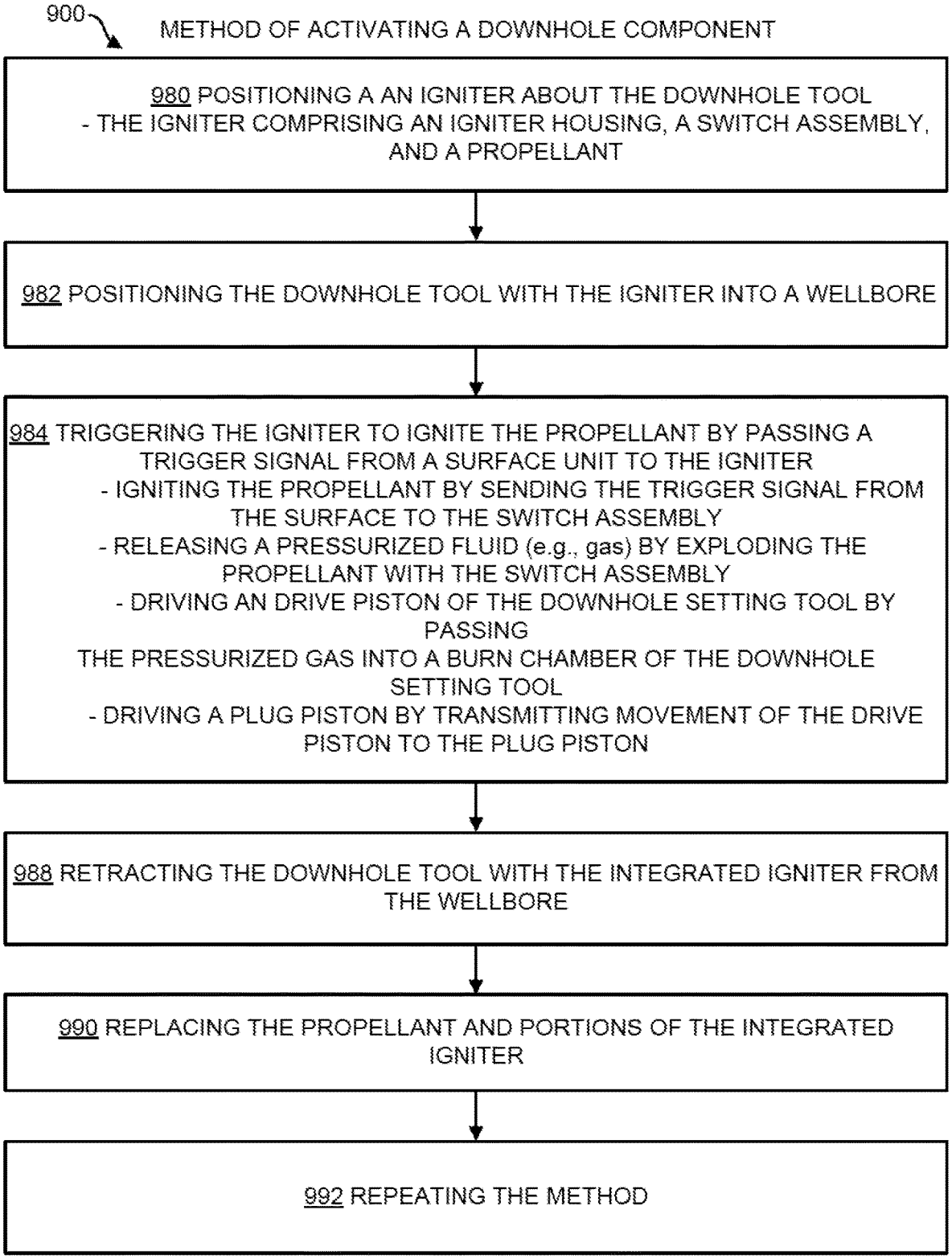
FIG. 9 is a flow chart depicting a method of activating a downhole component.

FIG. 9 is a flow chart depicting a method 900 of activating a downhole component. The method 900 involves 980 positioning an igniter about the downhole tool. The igniter may comprise an igniter housing, a switch assembly, and a propellant. The method 900 further involves 982 positioning the downhole tool with the igniter into a wellbore, and 984 triggering the igniter to ignite the propellant by passing a trigger signal from a surface unit to the igniter. The triggering 984 may involve igniting the propellant by sending the trigger signal from the surface to the switch assembly, releasing a pressurized fluid by exploding the propellant with the switch assembly, driving a drive piston of the downhole setting tool by passing the pressurized gas into a burn chamber of the downhole setting tool, and/or driving a plug piston by transmitting movement of the drive piston to the plug piston.

The method may also involve 988 retracting the downhole tool with the integrated igniter from the wellbore, 990 replacing the propellant and portions of the integrated igniter, and 992 repeating the method 900.

Part or all of the method 900 may be performed in various orders, and part or all may be repeated.

While the embodiments are described with reference to various implementations and exploitations, it will be understood that these embodiments are illustrative and that the scope of the inventive subject matter is not limited to them. Many variations, modifications, additions and improvements are possible. For example, various combinations of one or more of the features and/or methods provided herein may be used.

Plural instances may be provided for components, operations or structures described herein as a single instance. In general, structures and functionality presented as separate components in the exemplary configurations may be implemented as a combined structure or component. Similarly, structures and functionality presented as a single component may be implemented as separate components. These and other variations, modifications, additions, and improvements may fall within the scope of the inventive subject matter. For example, while certain tools and components are provided herein, it will be appreciated that various configurations (e.g., shape, order, orientation, etc.) of the tools and components herein may be used. While the figures herein depict a specific configuration or orientation, these may vary. First and second are not intended to limit the number or order.

Insofar as the description above and the accompanying drawings disclose any additional subject matter that is not within the scope of the claim(s) herein, the inventions are not dedicated to the public and the right to file one or more applications to claim such additional invention is reserved. Although a very narrow claim may be presented herein, it should be recognized the scope of this invention is much broader than presented by the claim(s). Broader claims may be submitted in an application that claims the benefit of priority from this application.

What is claimed is:

1. An igniter for activating a downhole component of a downhole tool, comprising:

an igniter housing positionable in the downhole tool, the igniter housing comprising an igniter portion and a nose portion, the igniter portion having a switch chamber therein, the nose portion having a propellant opening therethrough;

a switch assembly positioned in the switch chamber, the switch assembly comprising a switch movable between an untriggered and a triggered position; and a propellant supported by the nose portion, the propellant connected to the switch and ignitable thereby when the switch is moved to the triggered position whereby the propellant releases a pressurized fluid through the propellant opening to activate the downhole component;

wherein the switch assembly further comprises an insulator, a plunger, a plunger plug, a single igniter plug, and wires.

2. The igniter of claim 1, wherein the igniter housing further comprises a bulkhead connector connected to the igniter portion.

3. The igniter of claim 2, wherein the bulkhead connector is connected to the downhole component.

4. The igniter of claim 3, further comprising an o-ring positioned between the bulkhead connector and the igniter housing.

5. The igniter of claim 2, wherein the bulkhead connector is electrically connected to the switch assembly.

6. The igniter of claim 5, wherein the switch assembly is supported in the bulkhead connector by a compression spring.

7. The igniter of claim 5, wherein the switch assembly is electrically connected to at least one of portions of the downhole tool and a surface unit via the bulkhead connector.

8. The igniter of claim 5, wherein the switch assembly further comprises a bulkhead feedthrough connected to the bulkhead connector and a nose feedthrough connected to the propellant.

9. The igniter of claim 1, wherein the plunger plug comprises a plunger plate and plug contacts, the plug contacts connectable to the propellant.

10. The igniter of claim 1, wherein the switch comprises a switch housing, dual contacts, and dual igniter plugs.

11. The igniter of claim 1, wherein the switch assembly comprises one of a single addressable switch and a dual addressable switch.

12. The igniter of claim 1, wherein the nose portion comprises a tapered tip positionable at an end of the igniter housing.

13. The igniter of claim 1, wherein the nose portion comprises a locking ring positionable at an end of the igniter housing.

14. The igniter of claim 13, wherein the locking ring comprises a housing portion and a nose portion with the propellant opening therethrough, the housing portion connectable to the igniter housing, the nose portion connectable to the housing portion and shaped to support the propellant therein.

15. The igniter of claim 1, wherein the igniter housing is shaped for receipt within a downhole setting tool whereby the igniter is integratable within the downhole setting tool for internal use therein.

16. The igniter of claim 1, wherein the propellant is positioned internal to the igniter housing.

17. The igniter of claim 1, wherein the propellant is positioned external to the igniter housing.

18. A downhole tool, comprising:

a downhole component; and an igniter for activating the downhole component, the igniter comprising:

an igniter housing positioned in the downhole tool, the igniter housing comprising an igniter portion and a nose portion, the igniter portion having a switch chamber therein, the nose portion having a propellant opening therethrough;

a switch assembly positioned in the switch chamber, the switch assembly comprising a switch movable between an untriggered and a triggered position; and a propellant supported by the nose portion, the propellant connected to the switch and ignited thereby when the switch is moved to the triggered position whereby the propellant releases a gas through the propellant opening to activate the downhole component;

wherein the switch assembly further comprises an insulator, a plunger, a plunger plug, a single igniter plug, and wires.

19. The downhole tool of claim 18, wherein the downhole component is a downhole setting tool.

20. The downhole tool of claim 19, further comprising another downhole component comprising a plugging tool, the plugging tool operatively connected to the downhole setting tool and activatable thereby.

21. The downhole tool of claim 19, wherein the igniter is an integrated igniter positioned within the downhole setting tool.

22. The downhole tool of claim 19, further comprising an external propellant positioned external to the igniter housing and within the downhole setting tool.

23. A method of activating a downhole component of a downhole tool, comprising:

positioning an igniter within the downhole component of the downhole tool, the igniter comprising an igniter housing, a switch assembly, and a propellant;

positioning the downhole tool in a wellbore; and triggering the igniter to ignite the propellant by passing a trigger signal from a surface unit to the switch assembly such that the propellant is ignited and releases gas under pressure into the downhole component thereby shifting the downhole component;

wherein the switch assembly comprises a switch, an insulator, a plunger, a plunger plug, a single igniter plug, and wires.

24. The method of claim 23, wherein the downhole component is a setting tool and wherein shifting the downhole component comprises driving a drive piston of the setting tool by passing the gas into a burn chamber of the setting tool.

25. The method of claim 24, further comprising driving a plug piston of a plugging tool by transmitting movement of the drive piston to the plug piston.

26. The method of claim 23, further comprising retracting the downhole tool with the igniter from the wellbore.

27. The method of claim 26, further comprising replacing the propellant and portions of the igniter.

28. An igniter for activating a downhole component of a downhole tool, comprising:

an igniter housing positionable in the downhole tool, the igniter housing comprising an igniter portion and a nose portion, the igniter portion having a switch chamber therein, the nose portion having a propellant opening therethrough;

a switch assembly positioned in the switch chamber, the switch assembly comprising a switch movable between an untriggered and a triggered position; and a propellant supported by the nose portion, the propellant connected to the switch and ignitable thereby when the switch is moved to the triggered position whereby the propellant releases a pressurized fluid through the propellant opening to activate the downhole component;

wherein the switch assembly further comprises an insulator, a plunger, a plunger plug, a single igniter plug, and wires; and wherein the plunger plug comprises a plunger plate and plug contacts, the plug contacts connectable to the propellant.

29. An igniter for activating a downhole component of a downhole tool, comprising:

an igniter housing positionable in the downhole tool, the igniter housing comprising an igniter portion and a nose portion, the igniter portion having a switch chamber therein, the nose portion having a propellant opening therethrough;

a switch assembly positioned in the switch chamber, the switch assembly comprising a switch movable between an untriggered and a triggered position; and a propellant supported by the nose portion, the propellant connected to the switch and ignitable thereby when the switch is moved to the triggered position whereby the propellant releases a pressurized fluid through the propellant opening to activate the downhole component;

wherein the switch comprises a switch housing, dual contacts, and dual igniter plugs.

* * * * *